US009821427B2

(12) United States Patent
Fuwa et al.

(10) Patent No.: US 9,821,427 B2
(45) Date of Patent: Nov. 21, 2017

(54) GRINDING METHOD FOR WORKPIECES

(71) Applicant: DISCO CORPORATION, Tokyo (JP)

(72) Inventors: Naruto Fuwa, Tokyo (JP); Hideki Matsui, Tokyo (JP); Shinji Yamashita, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 0 days.

(21) Appl. No.: 14/937,229

(22) Filed: Nov. 10, 2015

(65) Prior Publication Data

US 2016/0136771 A1 May 19, 2016

(30) Foreign Application Priority Data

Nov. 17, 2014 (JP) ..... 2014-232561

(51) Int. Cl.
*B24B 5/00* (2006.01)
*B24B 7/16* (2006.01)
*B24B 7/22* (2006.01)

(52) U.S. Cl.
CPC ..... *B24B 5/00* (2013.01); *B24B 7/16* (2013.01); *B24B 7/228* (2013.01)

(58) Field of Classification Search
CPC ..... B24B 7/228; B24B 37/04; B24D 7/14
See application file for complete search history.

(56) References Cited

U.S. PATENT DOCUMENTS

2006/0063478 A1* 3/2006 Soma ..... B24D 7/14 451/541
2012/0088441 A1* 4/2012 Yamanaka ..... H01L 21/304 451/402
2013/0023188 A1* 1/2013 Wei ..... B24B 7/228 451/41

FOREIGN PATENT DOCUMENTS

JP 2010-247311 11/2010

* cited by examiner

*Primary Examiner* — Monica Carter
*Assistant Examiner* — Lauren Beronja
(74) *Attorney, Agent, or Firm* — Greer Burns & Crain, Ltd.

(57) ABSTRACT

A grinding method for grinding a plurality of platelike workpieces at a time is provided. The workpieces are attached to a support member and held on a chuck table. A grinding wheel is brought into contact with the workpieces to grind the workpieces at a time. The grinding wheel includes a disk-shaped wheel base having a first surface, a plurality of first abrasive members arranged annularly on the first surface of the wheel base, and a plurality of second abrasive members arranged annularly on the first surface of the wheel base radially inside the first abrasive members in a concentric relationship with the first abrasive members. The radial spacing between the first abrasive members and the second abrasive members is set larger than the minimum spacing between any adjacent ones of the workpieces.

15 Claims, 9 Drawing Sheets

GRINDING METHOD FOR WORKPIECES

BACKGROUND OF THE INVENTION

Field of the Invention

The present invention relates to a grinding method for grinding a plurality of platelike workpieces.

Description of the Related Art

In general, electronic devices such as ICs and LSIs are manufactured by using a silicon wafer. On the other hand, optical devices such as LEDs are frequently manufactured by using a sapphire substrate showing mechanically and thermally excellent characteristics and chemically stable. Further, in recent years, power devices for power control are occasionally manufactured by using an SiC substrate advantageous to higher breakdown voltage and lower loss.

In a sapphire substrate or SiC substrate more expensive than a silicon wafer, a diameter of about 2 inches to 4 inches is dominant. If such substrates having a small diameter are ground one by one, sufficient productivity cannot be maintained, so that there has been examined a grinding method capable of grinding a plurality of substrates at a time (see Japanese Patent Laid-open No. 2010-247311, for example).

SUMMARY OF THE INVENTION

However, in the case that the plural substrates are ground at a time by the above grinding method, there is a possibility that the peripheral portion of each substrate may be ground more than the central portion thereof, so that the whole work surface of each substrate cannot be flattened.

It is therefore an object of the present invention to provide a grinding method which can suitably flatten the whole work surface of each workpiece.

In accordance with an aspect of the present invention, there is provided a grinding method for grinding a plurality of platelike workpieces at a time by using a grinding apparatus including a chuck table for holding the platelike workpieces and grinding means having a grinding wheel for grinding the platelike workpieces, the grinding method including a workpiece attaching step of attaching the platelike workpieces to a support member; a holding step of holding the platelike workpieces attached to the support member on the chuck table; and a grinding step of bringing the grinding wheel into contact with the platelike workpieces to grind the platelike workpieces at a time; the grinding wheel including a disk-shaped wheel base having a first surface, a plurality of first abrasive members arranged annularly on the first surface of the wheel base, and a plurality of second abrasive members arranged annularly on the first surface of the wheel base radially inside the first abrasive members in a concentric relationship with the first abrasive members; the radial spacing between the first abrasive members and the second abrasive members being set larger than the minimum spacing between any adjacent ones of the platelike workpieces.

Preferably, the number of the second abrasive members arranged on the wheel base is set smaller than the number of the first abrasive members arranged on the wheel base. As a modification, preferably, the wear resistance of the second abrasive members arranged on the wheel base is set lower than the wear resistance of the first abrasive members arranged on the wheel base. For example, each of the platelike workpieces includes a sapphire substrate or an SiC substrate.

In the grinding method according to the present invention, the grinding wheel has the plural first abrasive members arranged annularly and the plural second abrasive members arranged annularly radially inside the first abrasive members, wherein the outer ring formed by the first abrasive members is concentric with the inner ring formed by the second abrasive members. Furthermore, the radial spacing between the outer ring of the first abrasive members and the inner ring of the second abrasive members is set larger than the minimum spacing between any adjacent ones of the platelike workpieces. Thus, the platelike workpieces are ground at a time by using this grinding wheel. Accordingly, a grinding pressure applied by the grinding wheel can be distributed by the first abrasive members and the second abrasive members. In particular, the grinding pressure to be applied to the peripheral portion of each workpiece can be reduced, so that it is possible to prevent the problem that the peripheral portion of each workpiece is ground more than the central portion thereof. That is, the grinding method according to the present invention has an effect that the whole work surface of each workpiece can be suitably flattened.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

A preferred embodiment of the present invention will now be described with reference to the attached drawings. The grinding method according to this preferred embodiment includes a workpiece attaching step, a holding step, and a grinding step. In the workpiece attaching step, a plurality of workpieces as a target to be ground are attached to a support member. In the holding step, the plural workpieces attached to the support member are held on a chuck table. In the grinding step, a grinding wheel is brought into contact with the plural workpieces to grind the plural workpieces at a time. The grinding method according to this preferred embodiment will now be described in more detail.

Figure 1:
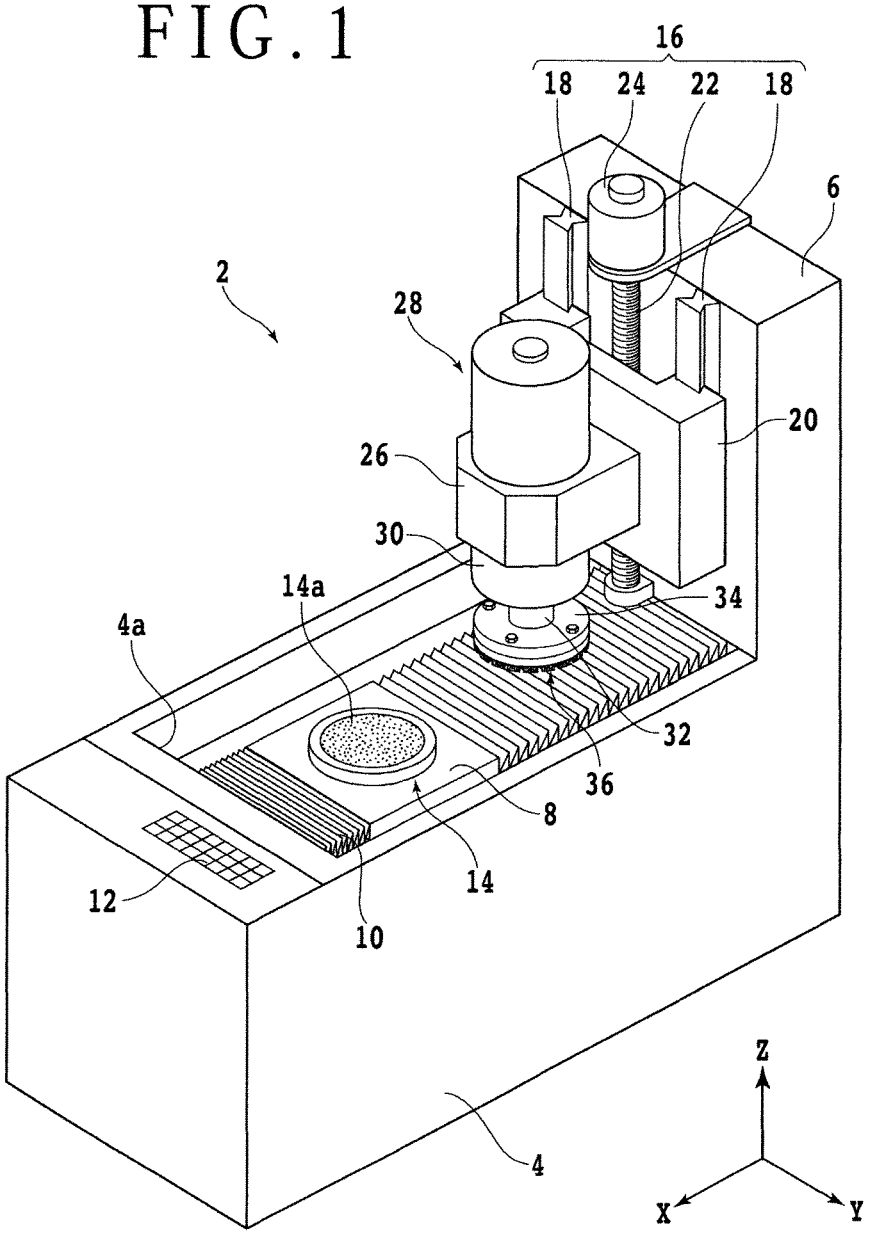
FIG. 1 is a schematic perspective view of a grinding apparatus usable in the present invention.

First, there will be described a grinding apparatus for use in performing the grinding method according to this preferred embodiment. FIG. 1 is a schematic perspective view of a grinding apparatus 2 usable in this preferred embodiment. As shown in FIG. 1, the grinding apparatus 2 includes a boxlike base 4 for mounting various structures therein and thereon. A support wall 6 is formed at the rear end of the base 4 so as to extend upright.

The upper surface of the base 4 is formed with a rectangular opening or recess 4*a* elongated in the X direction (longitudinal direction). There are provided in the opening 4*a* an X table 8, an X moving mechanism (not shown) for moving the X table 8 in the X direction, and a drip-proof dust cover 10 for covering the X moving mechanism. An operation panel 12 for inputting grinding conditions etc. is provided on the front side of the opening 4*a*. The X moving mechanism includes a pair of parallel X guide rails (not shown) extending in the X direction. The X table 8 is slidably mounted on the X guide rails. A nut portion (not shown) is provided on the lower surface of the X table 8, and an X ball screw (not shown) extending parallel to the X guide rails is threadedly engaged with this nut portion of the X table 8. An X pulse motor (not shown) is connected to one end of the X ball screw. Accordingly, when the X pulse motor is operated to rotate the X ball screw, the X table 8 is moved along the X guide rails in the X direction.

A chuck table 14 for holding a plurality of platelike workpieces 11 (see FIG. 2, for example) under suction is provided on the X table 8. The chuck table 14 is connected to a rotational drive source (not shown) such as a motor, so that the chuck table 14 is rotatable about an axis extending in the Z direction (vertical direction) by this rotational drive source. The chuck table 14 is also movable in the X direction together with the X table 8 by the X moving mechanism. The chuck table 14 has an upper surface as a holding surface 14*a* for holding the workpieces 11 under suction. The holding surface 14*a* is connected to a vacuum source (not shown) through a suction passage (not shown) formed in the chuck table 14. Accordingly, the workpieces 11 placed on the chuck table 14 are held on the chuck table 14 under suction by the vacuum applied from the vacuum source to the holding surface 14*a*.

A Z moving mechanism 16 is provided on the front surface of the support wall 6. The Z moving mechanism 16 includes a pair of parallel Z guide rails 18 extending in the Z direction. A Z plate 20 is slidably mounted on the Z guide rails 18. A nut portion (not shown) is provided on the rear surface (back side) of the Z plate 20, and a Z ball screw 22 extending parallel to the Z guide rails 18 is threadedly engaged with this nut portion of the Z plate 20. A Z pulse motor 24 is connected to one end of the Z ball screw 22. Accordingly, when the Z pulse motor 24 is operated to rotate the Z ball screw 22, the Z plate 20 is moved along the Z guide rails 18 in the Z direction.

A support structure 26 is provided on the front surface (front side) of the Z plate 20 so as to project frontward. A grinding unit (grinding means) 28 for grinding the workpieces 11 is supported to the support structure 26. The grinding unit 28 includes a spindle housing 30 fixed to the support structure 26. A spindle 32 as a rotating shaft is rotatably supported to the spindle housing 30. A disk-shaped wheel mount 34 is provided at the lower end (front end) of the spindle 32. A disk-shaped (annular) grinding wheel 36 having substantially the same diameter as the diameter of the wheel mount 34 is fixed to the lower surface of the wheel mount 34 by bolts or the like. The grinding wheel 36 will be hereinafter described in more detail. A rotational drive source (not shown) such as a motor is connected to the upper end (base end) of the spindle 32. Accordingly, the grinding wheel 36 is rotatable about an axis extending in the Z direction by the torque transmitted from this rotational drive source. In grinding the workpieces 11, both of the chuck table 14 and the grinding wheel 36 are rotated and the grinding wheel 36 is lowered to come into contact with the workpieces 11 held on the chuck table 14 as supplying a grinding fluid such as pure water to the workpieces 11, thereby grinding the workpieces 11.

Figure 2:
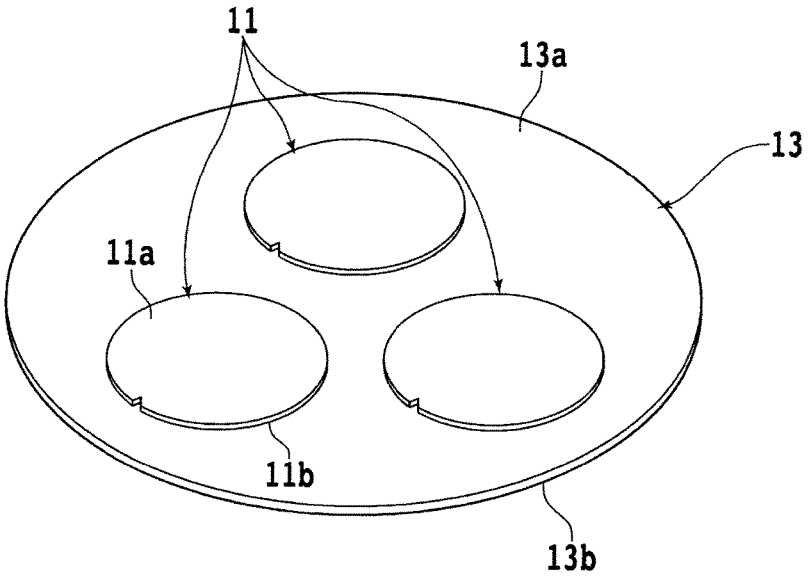
FIG. 2 is a schematic perspective view showing a workpiece attaching step in a preferred embodiment of the present invention.

The grinding method using the grinding apparatus 2 according to this preferred embodiment will now be described in detail. First, the workpiece attaching step according to this preferred embodiment is performed in such a manner that the plural workpieces 11 as a target to be ground are attached to a support member. FIG. 2 is a schematic perspective view showing the workpiece attaching step according to this preferred embodiment. As shown in FIG. 2, three workpieces 11 are attached to a support memer 13 in this workpiece attaching step. Each workpiece 11 is a disk-shaped sapphire substrate or SiC substrate having a thickness of 650 μm, for example. However, the workpieces to be ground in the present invention are not limited to such substrates, but various platelike workpieces may be suitably ground by the grinding method of the present invention. Each workpiece 11 has a front side 11*a* and a back side 11*b*. In this preferred embodiment, the front side 11*a* of each workpiece 11 is ground. The support member 13 is a platelike member having a size capable of mounting the platelike workpieces 11 in the same plane without overlapping. The support member 13 is formed of ceramic or the like. In this preferred embodiment, the support member 13 is a disk-shaped support member having a size capable of mounting the three workpieces 11 as shown in FIG. 2. The support member 13 has a front side 13*a* and a back side 13*b*. However, the support member usable in the present invention is not limited to the support member 13 shown in FIG. 2.

In the workpiece attaching step, the three workpieces 11 are placed on the support member 13 in such a manner that the back side 11*b* of each workpiece 11 faces the front side 13*a* of the support member 13. The three workpieces 11 are placed so as not overlap each other. Further, a wax (adhesive) is interposed between the support member 13 and each workpiece 11. Accordingly, the back side 11*b* of each workpiece 11 can be attached to the front side 13*a* of the support member 13.

After performing the workpiece attaching step, the holding step is performed in such a manner that the plural workpieces 11 attached to the support member 13 are held on the chuck table 14. In this holding step, the support member 13 is placed on the chuck table 14 in such a manner that the back side 13*b* of the support member 13 faces the holding surface 14*a* of the chuck table 14. Thereafter, the vacuum produced in the vacuum source is applied to the holding surface 14*a* of the chuck table 14. Accordingly, the plural workpieces 11 attached to the support member 13 are held through the support member 13 on the chuck table 14 under suction.

Figure 3:
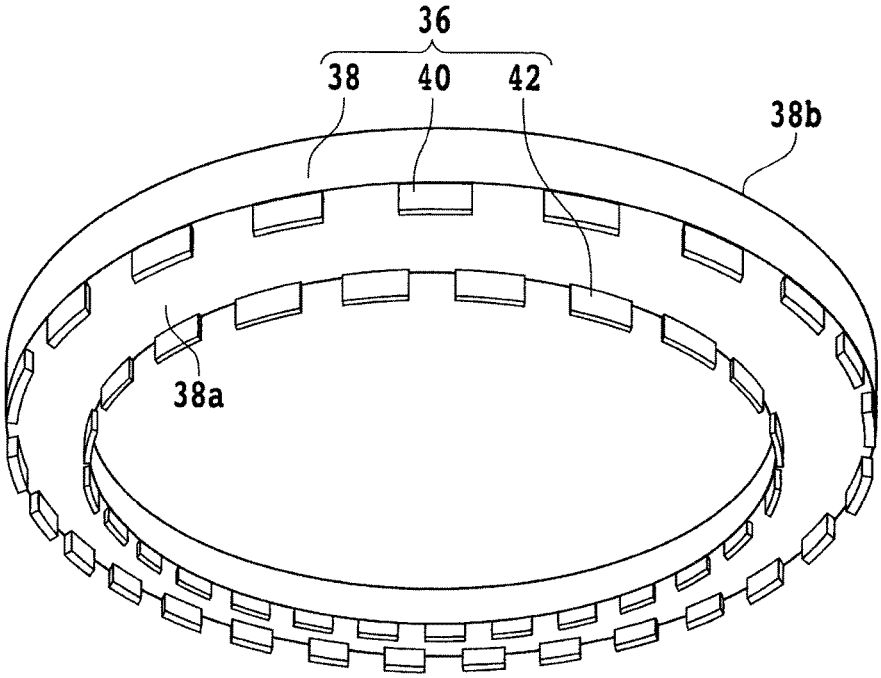
FIG. 3 is a schematic perspective view of a grinding wheel for grinding a plurality of workpieces.
Figure 4:
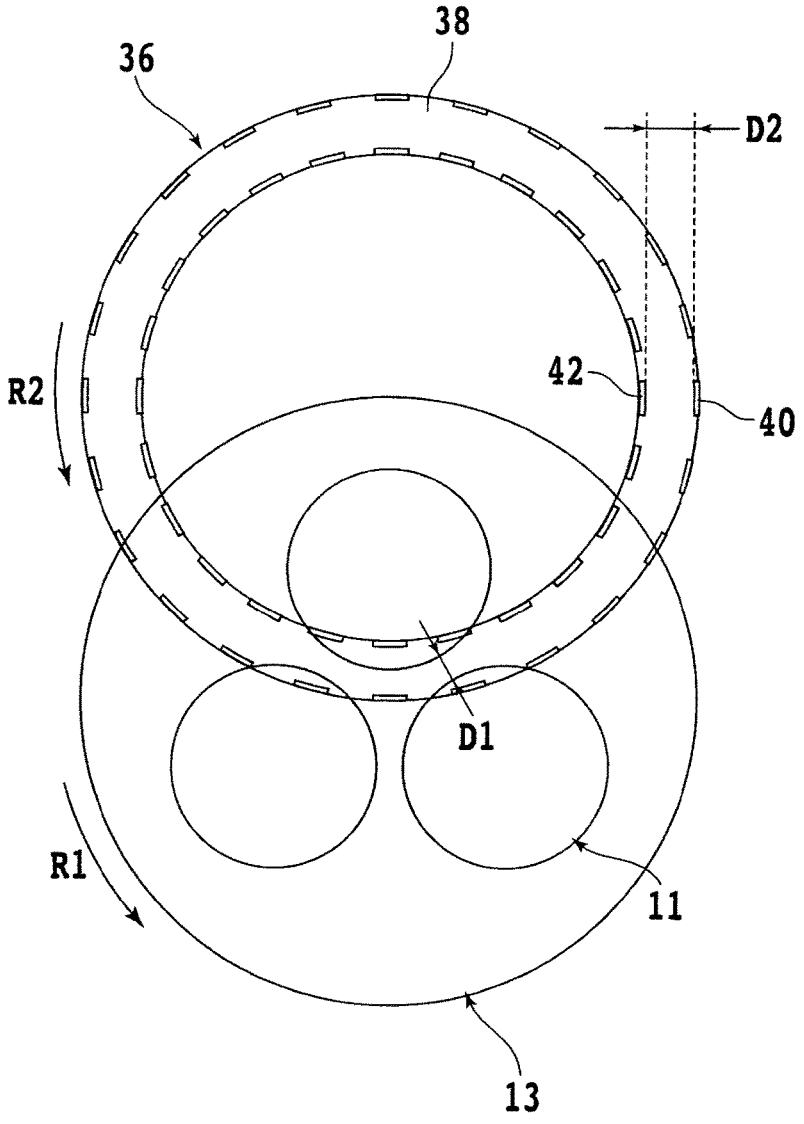
FIG. 4 is a schematic plan view showing a positional relation between each workpiece and the grinding wheel shown in FIG. 3.

After performing the holding step, the grinding step is performed in such a manner that the plural workpieces 11 are ground at a time. FIG. 3 is a schematic perspective view of the grinding wheel 36, and FIG. 4 is a schematic plan view showing a positional relation between each workpiece 11 and the grinding wheel 36 during the grinding step. As shown in FIG. 3, the grinding wheel 36 includes a disk-shaped (annular) wheel base 38 having a central opening. The wheel base 38 has a first surface 38*a* and a second surface 38*b*. A plurality of first abrasive members 40 are fixed to the first surface 38*a* of the wheel base 38 so as to be arranged annularly at intervals along the outer circumference of the wheel base 38. Further, a plurality of second abrasive members 42 are fixed to the first surface 38*a* of the wheel base 38 in an area inside the plural first abrasive members 40 (radially inside the plural first abrasive members 40) so as to be arranged annularly at intervals along the inner circumference of the wheel base 38. That is, the outer ring formed by the plural first abrasive members 40 and the inner ring formed by the plural second abrasive members 42 are concentrically arranged on the first surface 38*a* of the wheel base 38. As shown in FIG. 4, the spacing (radial spacing) D2 between the outer ring of the first abrasive members 40 and the inner ring of the second abrasive members 42 is set larger than the minimum spacing D1 between any adjacent ones of the three workpieces 11, wherein the three workpieces 11 are arranged at intervals. The grinding wheel 36 is mounted on the lower surface of the wheel mount 34 in such a manner that the second surface 38*b* opposite to the first surface 38*a* of the wheel base 38 comes into contact with the lower surface of the wheel mount 34, wherein the first and second abrasive members 40 and 42 are previously fixed to the first surface 38*a*.

In the grinding step, the chuck table 14 is rotated in the direction shown by an arrow R1 at a predetermined speed, and the grinding wheel 36 is also rotated in the direction shown by an arrow R2 at a predetermined speed. For example, the rotational speed of the chuck table 14 is set to about 300 rpm, and the rotational speed of the grinding wheel 36 is set to about 800 rpm. However, the grinding conditions are not limited to the above. Thereafter, the grinding wheel 36 is lowered until the lower ends of the first and second abrasive members 40 and 42 come into contact with the front sides 11*a* of the three workpieces 11 as supplying a grinding fluid such as pure water to the workpieces 11. Accordingly, the plural workpieces 11 can be ground at a time. When each workpiece 11 is ground to reach a desired thickness (e.g., 160 μm), the grinding step is finished.

Figure 5:
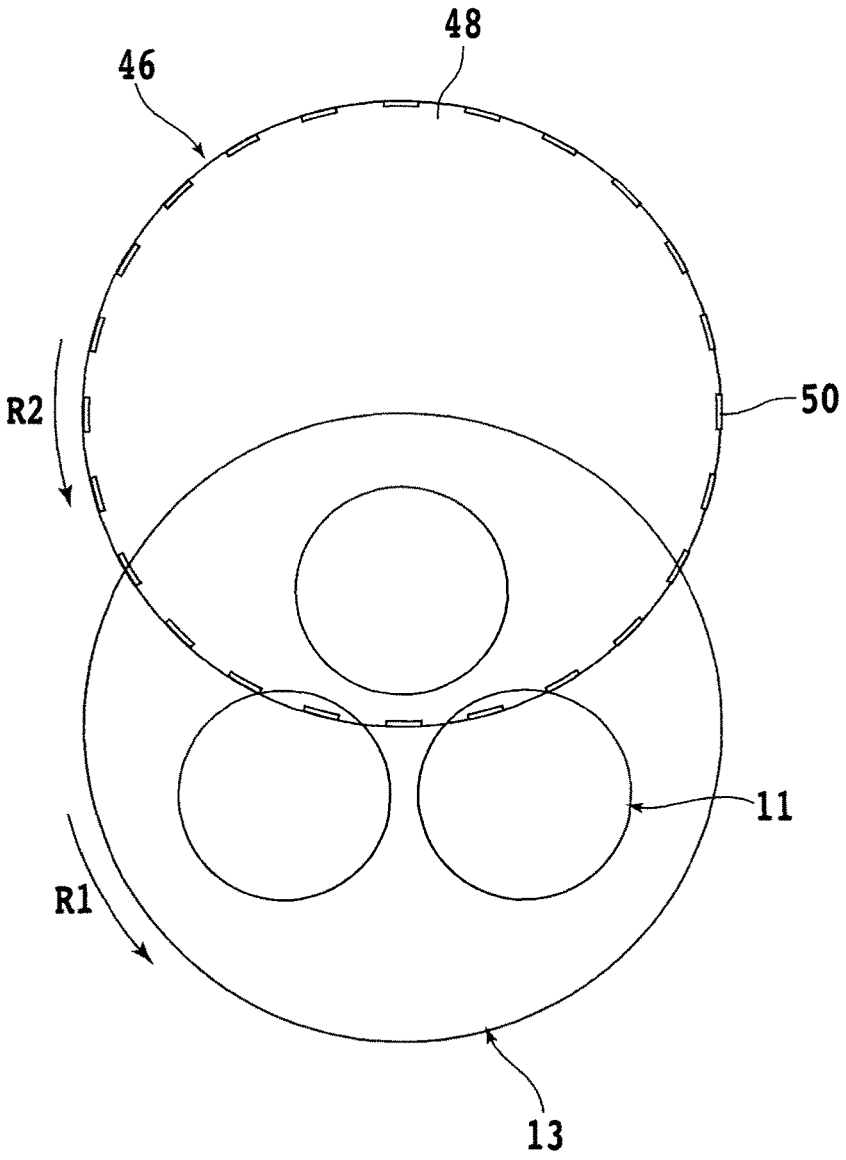
FIG. 5 is a schematic plan view showing a positional relation between each workpiece and a grinding wheel as a comparison.

FIG. 5 is a schematic plan view showing a positional relation between each workpiece 11 and a grinding wheel 46 as a comparison. As shown in FIG. 5, the grinding wheel 46 is composed of a disk-shaped wheel base 48 and a plurality of abrasive members 50 arranged annularly along the outer circumference of the wheel base 48. In FIG. 5, a grinding pressure by the grinding wheel 46 is applied to only the peripheral portions of any two ones of the three workpieces 11. In contrast, the grinding wheel 36 in this preferred embodiment is configured so that the outer ring of the first abrasive members 40 and the inner ring of the second abrasive members 42 are concentrically arranged and that the spacing D2 between the outer ring of the first abrasive members 40 and the inner ring of the second abrasive members 42 is set larger than the minimum spacing D1 between any adjacent ones of the plural workpieces 11. Accordingly, in FIG. 4, a grinding pressure by the grinding wheel 36 is applied to the three workpieces 11.

In the grinding method according to this preferred embodiment as described above, the grinding pressure is distributed by the first abrasive members 40 and the second abrasive members 42 to grind the plural workpieces 11. In particular, the grinding pressure to be applied to the peripheral portion of each workpiece 11 can be reduced, so that it is possible to prevent the problem that the peripheral portion of each workpiece 11 is ground more than the central portion thereof. That is, the grinding method according to this preferred embodiment has an effect that the whole work surface of each workpiece 11 can be suitably flattened.

In the grinding wheel 36 according to this preferred embodiment, the second abrasive members 42 are arranged radially inside the first abrasive members 40. Accordingly, the moving speed of the second abrasive members 42 with respect to the workpieces 11 is lower than the moving speed of the first abrasive members 40 with respect to the workpieces 11 in grinding the workpieces 11. As a result, a difference in wear amount is prone to generate between the first abrasive members 40 and the second abrasive members 42. To cope with this problem, the number of the second abrasive members 42 is preferably set smaller than the number of the first abrasive members 40. Alternatively, the wear resistance of the second abrasive members 42 is preferably set lower than the wear resistance of the first abrasive members 40. Accordingly, the difference in wear amount between the first abrasive members 40 and the second abrasive members 42 can be sufficiently reduced to thereby suitably flatten the whole work surface of each workpiece 11. In the case that the wear resistance of the second abrasive members 42 is set lower than the wear resistance of the first abrasive members 40, the degree of concentration of abrasive grains contained in the second abrasive members 42 may be set lower than the degree of concentration of abrasive grains contained in the first abrasive members 40. Alternatively, the bonding material contained in the second abrasive members 42 may be made softer than the bonding material contained in the first abrasive members 40. The wear resistance of the first and second abrasive members 40 and 42 may be determined according to Young's modulus or bending strength, for example.

Figure 6:
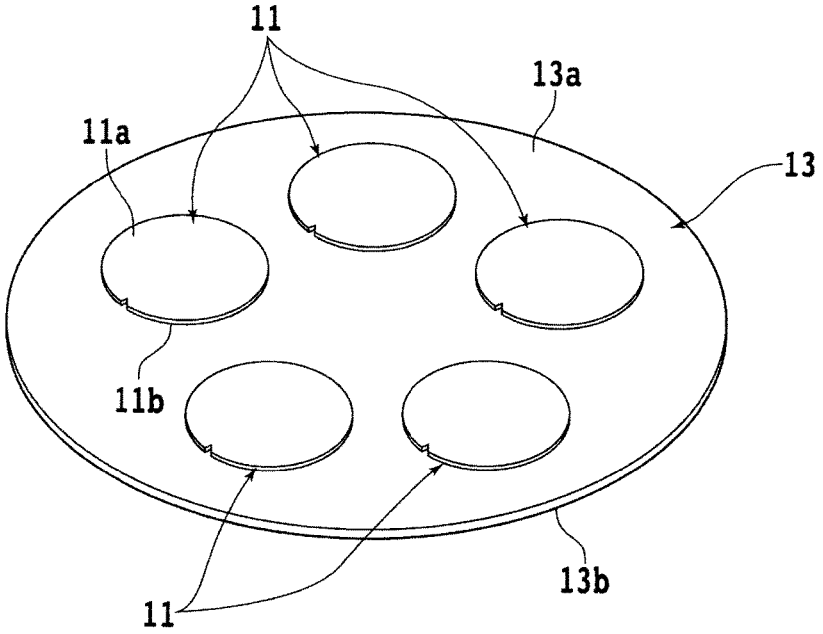
FIG. 6 is a schematic perspective view showing a workpiece attaching step according to a modification of the above preferred embodiment.
Figure 7:
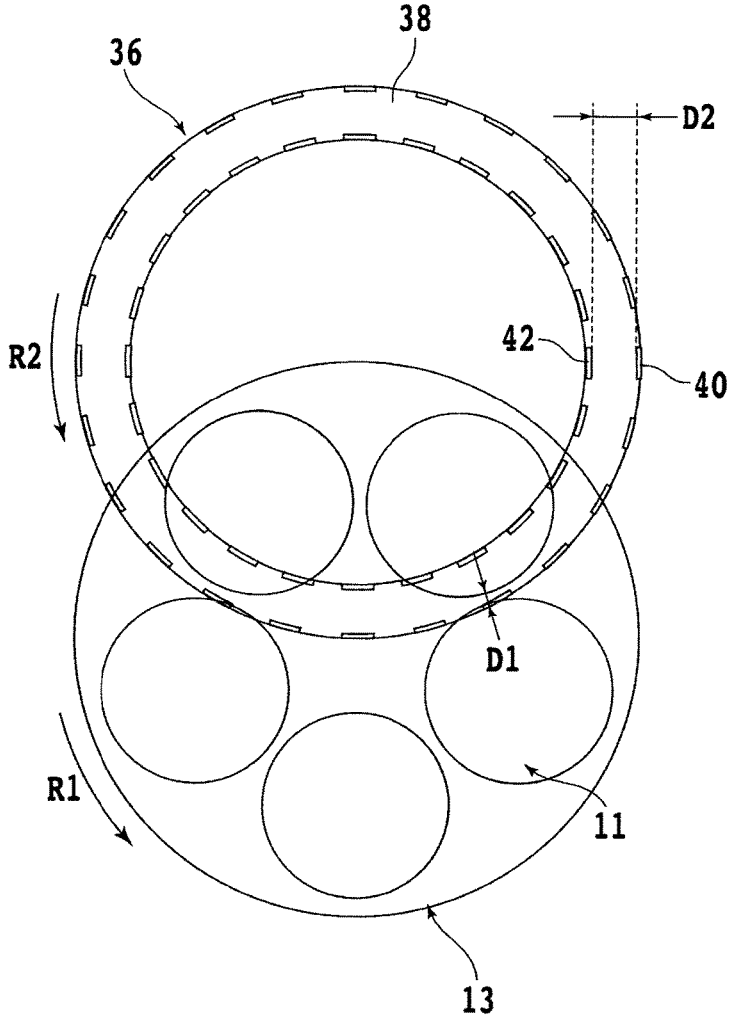
FIG. 7 is a schematic plan view showing a positional relation between each workpiece and the grinding wheel in this modification.
Figure 8:
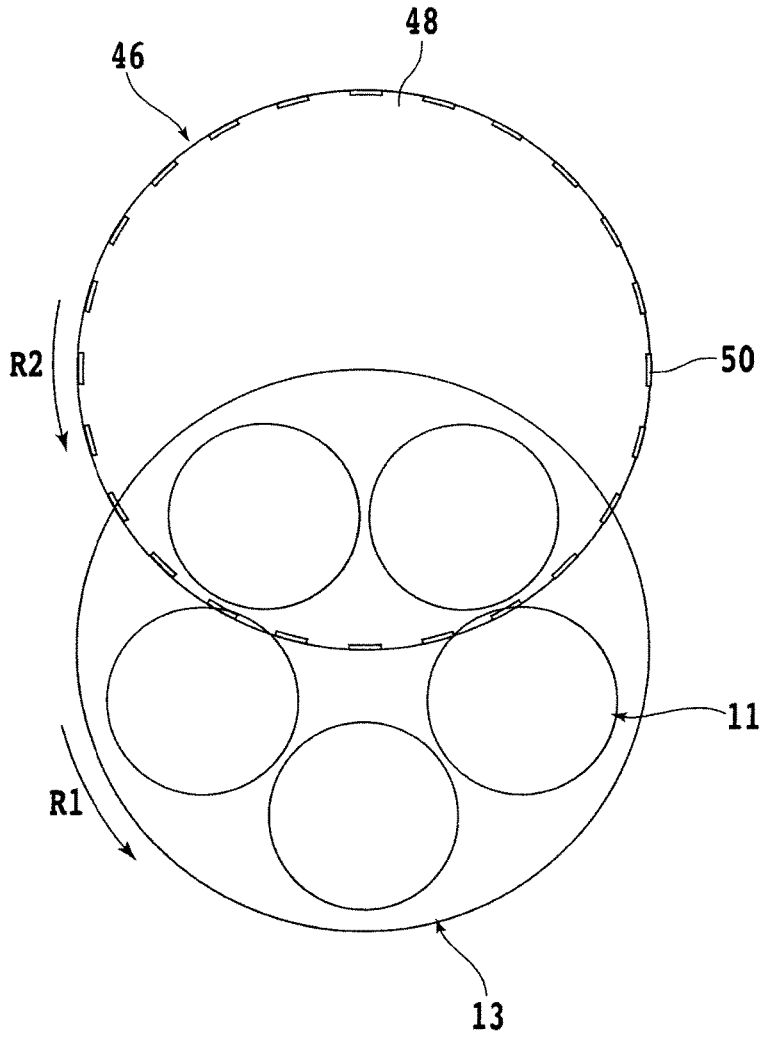
FIG. 8 is a schematic plan view showing a comparison to the configuration shown in FIG. 7.

The present invention is not limited to the above preferred embodiment, but various modifications may be made. For example, while the three workpieces 11 are attached to the support member 13 and then ground at a time in the above preferred embodiment, the number of workpieces 11 to be attached to the support member 13 is not especially limited. FIG. 6 is a schematic perspective view showing a workpiece attaching step according to a modification of the above preferred embodiment, and FIG. 7 is a schematic plan view showing a positional relation between each workpiece 11 and the grinding wheel 36 in this modification. As shown in FIG. 6, five workpieces 11 are attached to the support member 13 in this modification. As shown in FIG. 7, the spacing (radial spacing) D2 between the outer ring of the first abrasive members 40 and the inner ring of the second abrasive members 42 is set larger than the minimum spacing D1 between any adjacent ones of the five workpieces 11, wherein the five workpieces 11 are arranged at intervals. This configuration is similar to that shown in FIG. 4. As a result, the grinding pressure is applied to any four ones of the five workpieces 11 in the condition shown in FIG. 7. FIG. 8 shows a comparison to the configuration shown in FIG. 7. In this comparison shown in FIG. 8, the grinding pressure is applied to only the peripheral portions of any two ones of the five workpieces 11. Also in the modification shown in FIG. 7, the grinding pressure can be distributed by the first abrasive members 40 and the second abrasive members 42. In particular, the grinding pressure to be applied to the peripheral portion of each workpiece 11 can be reduced, so that it is possible to prevent the problem that the peripheral portion of each workpiece 11 is ground more than the central portion thereof.

Figure 9A:
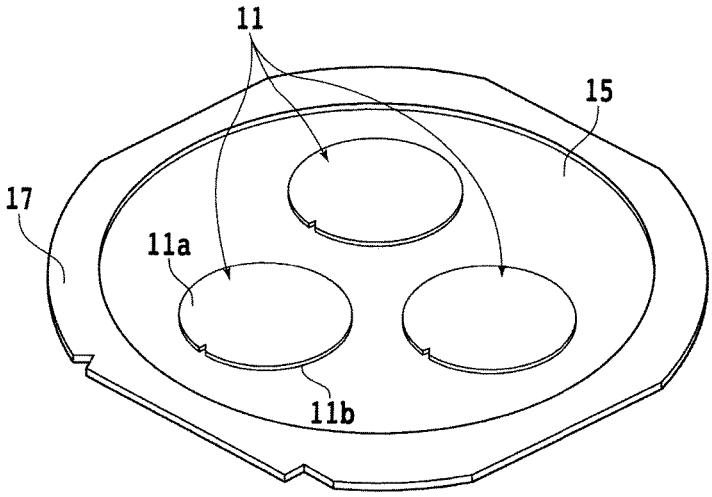
FIGS. 9A and 9B are schematic perspective views showing the condition that the plural workpieces are attached to an adhesive tape.
Figure 9B:
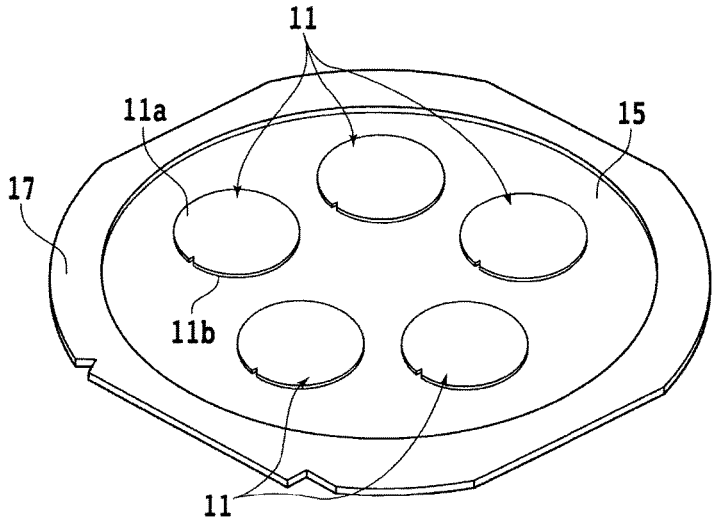

Further, while a platelike member formed of ceramic or the like is used as the support member 13 in the above preferred embodiment and the modification, an adhesive tape or the like may be used as the support member in the present invention. FIGS. 9A and 9B are schematic perspective views showing the condition that the plural workpieces 11 are attached to an adhesive tape 15 as the support member, wherein FIG. 9A shows the case that the three workpieces 11 are used and FIG. 9B shows the case that the five workpieces 11 are used. Also in such a case that the plural workpieces 11 are attached to the adhesive tape 15 as shown in FIGS. 9A and 9B, each workpiece 11 can be ground in a similar manner. In this case, an annular frame 17 is preferably fixed to the peripheral portion of the adhesive tape 15 as shown in FIGS. 9A and 9B.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A grinding method for grinding a plurality of platelike workpieces at a time by using a grinding apparatus including a chuck table for holding said platelike workpieces and grinding means having a grinding wheel for grinding said platelike workpieces, said grinding method, comprising:

a workpiece attaching step of attaching said platelike workpieces to a support member;

a holding step of holding said platelike workpieces attached to said support member on said chuck table; and a grinding step of bringing said grinding wheel into contact with said platelike workpieces to grind said platelike workpieces at a time;

said grinding wheel including a disk-shaped wheel base having a first surface, a plurality of first abrasive members arranged annularly on the first surface of said wheel base, and a plurality of second abrasive members arranged annularly on the first surface of said wheel base radially inside said first abrasive members in a spaced, concentric relationship with said first abrasive members;

wherein radial spacing between said first abrasive members and said second abrasive members is set larger than the minimum spacing between any adjacent ones of said platelike workpieces, wherein during said grinding step, at least some of said plurality of first abrasive members are in contact with at least a first one of said platelike workpieces while at least some of said plurality of said second abrasive members are in contact with at least a second one of said platelike workpieces.

2. The grinding method according to claim 1, wherein a number of said second abrasive members arranged on said wheel base is set smaller than a number of said first abrasive members arranged on said wheel base.

3. The grinding method according to claim 1, wherein wear resistance of said second abrasive members arranged on said wheel base is set lower than wear resistance of said first abrasive members arranged on said wheel base.

4. The grinding method according to claim 1, wherein each of said platelike workpieces comprises a sapphire substrate or an SiC substrate.

5. The grinding method according to claim 1, wherein:

said first abrasive members are arranged annularly at intervals only along an outer circumference of said wheel base, with a first predetermined radial spacing therebetween; and said second abrasive members are arranged annularly at intervals only along an inner circumference of said wheel base, with a second predetermined radial spacing therebetween.

6. The grinding method according to claim 1, wherein:

said workpiece attaching step comprises attaching three of said platelike workpieces to said support member via an adhesive; and said grinding step comprises having at least some of said plurality of first abrasive members in contact with two of said platelike workpieces while simultaneously having at least some of said plurality of said second abrasive members in contact with at least one of said platelike workpieces, wherein said platelike workpiece in contact with at least some of said plurality of said second abrasive members is different from said two platelike workpieces in contact with at least some of said plurality of first abrasive members.

7. The grinding method according to claim 1, wherein:

said workpiece attaching step comprises attaching five of said platelike workpieces to said support member via an adhesive; and said grinding step comprises having at least some of said plurality of first abrasive members in contact with a first pair of said platelike workpieces while simultaneously having at least some of said plurality of said second abrasive members in contact with a second pair of said platelike workpieces, wherein said second pair of said platelike workpieces in contact with at least some of said plurality of said second abrasive members is different from said first pair of said platelike workpieces in contact with at least some of said plurality of first abrasive members.

8. A grinding method for grinding a plurality of platelike workpieces at a time by using a grinding apparatus including a chuck table for holding said platelike workpieces and grinding means having a grinding wheel for grinding said platelike workpieces, said grinding method, comprising:

a workpiece attaching step of attaching said platelike workpieces to a support member;

a holding step of holding said platelike workpieces attached to said support member on said chuck table, wherein the holding step is performed by applying a vacuum to said chuck table to thereby hold said support member on said chuck table under suction; and a grinding step of bringing said grinding wheel into contact with said platelike workpieces to grind said platelike workpieces at a time;

said grinding wheel including a disk-shaped wheel base having a first surface, a plurality of first abrasive members arranged annularly on the first surface of said wheel base, and a plurality of second abrasive members arranged annularly on the first surface of said wheel base radially inside said first abrasive members in a concentric relationship with said first abrasive members;

wherein radial spacing between said first abrasive members and said second abrasive members is set larger than the minimum spacing between any adjacent ones of said platelike workpieces.

9. The grinding method according to claim 8, wherein a number of said second abrasive members arranged on said wheel base is set smaller than a number of said first abrasive members arranged on said wheel base.

10. The grinding method according to claim 8, wherein wear resistance of said second abrasive members arranged on said wheel base is set lower than wear resistance of said first abrasive members arranged on said wheel base.

11. The grinding method according to claim 8, wherein each of said platelike workpieces comprises a sapphire substrate or an SiC substrate.

12. The grinding method according to claim 8, wherein:

said workpiece attaching step comprises attaching three of said platelike workpieces to said support member via an adhesive; and said grinding step comprises having at least some of said plurality of first abrasive members in contact with two of said platelike workpieces while simultaneously having at least some of said plurality of said second abrasive members in contact with at least one of said platelike workpieces, wherein said platelike workpiece in contact with at least some of said plurality of said second abrasive members is different from said two platelike workpieces in contact with at least some of said plurality of first abrasive members.

13. The grinding method according to claim 8, wherein:

said workpiece attaching step comprises attaching five of said platelike workpieces to said support member via an adhesive; and said grinding step comprises having at least some of said plurality of first abrasive members in contact with a first pair of said platelike workpieces while simultaneously having at least some of said plurality of said second abrasive members in contact with a second pair of said platelike workpieces, wherein said second pair of said platelike workpieces in contact with at least some of said plurality of said second abrasive members is different from said first pair of said platelike workpieces in contact with at least some of said plurality of first abrasive members.

14. The grinding method according to claim 8, wherein said workpiece attaching step comprises attaching said plurality of said platelike workpieces to said support member via an adhesive.

15. The grinding method according to claim 1, wherein said workpiece attaching step comprises attaching said plurality of said platelike workpieces to said support member via an adhesive.

* * * * *